US005163517A

United States Patent [19]

Kozai et al.

[11] Patent Number: 5,163,517

[45] Date of Patent: Nov. 17, 1992

[54] FIRE EXTINGUISHING SYSTEMS

[75] Inventors: Teruo Kozai; Shinya Hashimoto, both of Yamagata, Japan

[73] Assignee: NEC Corporation, Tokyo, Japan

[21] Appl. No.: 784,266

[22] Filed: Oct. 29, 1991

[30] Foreign Application Priority Data

Oct. 29, 1990 [JP] Japan ..... 2-291630

[51] Int. Cl.[5] ..... A62C 37/10

[52] U.S. Cl. ..... 169/60; 169/49; 169/46; 169/54

[58] Field of Search ..... 169/49, 60, 61, 43, 169/46, 91, 54

[56] References Cited

U.S. PATENT DOCUMENTS 3,517,746 6/1970 Balmes ..... 169/61 X 4,860,832 8/1989 Levillain ..... 169/49

FOREIGN PATENT DOCUMENTS 1335299 9/1987 U.S.S.R. ..... 169/46

OTHER PUBLICATIONS

"Series 27100, 28000 Detect-A-Fire Vertical Units" Fenwal Inc., Ashland, Mass.; 1990.

*Primary Examiner*—Margaret A. Focarino

*Assistant Examiner*—Gary C. Hoge

*Attorney, Agent, or Firm*—Leydig, Voit & Mayer

[57] ABSTRACT

This invention is relates to a fire extinguishing system which obstructs a fire in a chemical bath containing a flammable chemical arranged within a closed space of high airtightness. The fire extinguishing system includes detecting means which generates a detection signal by detecting flames outbroken on the surface of the chemical, an injection nozzle which jets out a nonflammable gas toward the liquid surface of the chemical in response to the detection signal, an auxiliary bath which temporarily stores the chemical by discharging the chemical from the chemical bath in response to the detection signal, a feed water equipment which supplies water to the auxiliary bath in response to the detection signal to dilute and cool the chemical, a pipeline which discharges the vapor component of the chemical within the chemical bath from the closed space, and an inert gas supplying device which supplies an inert gas in order to dilute the vapor component of the chemical within the auxiliary bath.

5 Claims, 3 Drawing Sheets

FIRE EXTINGUISHING SYSTEMS

BACKGROUND OF THE INVENTION

1. Field of the Invention

The present invention relates to fire extinguishing systems installed on a flammable chemical bath within a room, such as a clean room, a laboratory or a chemical treatment room for components manufactured, where flammable chemicals are handled and yet is inaccessible for fire engines or the like.

2. Description of the Prior Art

Facilities for manufacturing electronic components, especially those electronic components requiring a precise working such as semiconductor devices, are arranged in a closed room having a high air cleanliness such as a clean room. These facilities include an exposure system, a diffusion facility or a chemical treatment bath. Of these facilities one which tends to catch fire is the chemical treatment bath. In particular, a chemical bath for cleaning which is one type of the chemical treatment bath is liable to catch fire. This is because the bath is storing a flammable chemical such as isopropyl alcohol.

Generally, a chemical treatment facility of the above-mentioned type is constituted of a large number of baths respectively containing various kinds of chemicals that are arranged in one direction, and a carrier which runs over these baths by having on board the components to be treated. Accordingly, if fire occurs in one bath, fire spreads to other baths by leaping flames, and there is a hazard of eventually reducing the building to ashes.

As a fire extinguishing facility for baths of flammable chemicals of the above-mentioned kind, system that jets out an incombustible gas which shuts off the inflow of the air has been employed in order to suppress the contamination or damage that occurs at the time of fire extinguishing to a possible minimum level.

A fire extinguishing facility of this kind is constituted of a fire detector which is arranged in the neighborhood of the chemical baths which are the objects of extinction and detects the occurrence of a fire, a valve which opens its valve seat in response to the detection signal of the fire detector, a carbon dioxide container connected to one opening of the valve through a pipeline for supplying carbon dioxide as an extinguishing gas, and a carbon dioxide injection nozzle which is connected to the other opening of the valve and is arranged in the region where the chemical baths are installed, as is disclosed, for example, in the catalog entitled "Series 27100, 2800 Detect-a-Fire ® Vertical Units" prepared by Fenwal, Inc. (400 Main Street, Ashland, Mass., U.S.A.).

When the fire detector detects the temperature rise, infrared rays or ultraviolet rays due to the occurrence of a fire, the detector issues a signal, the valve is opened in response to the signal, carbon dioxide is supplied to the injection nozzle from the carbon dioxide container, and carbon dioxide is discharged from the injection nozzle toward the chemical bath installation region to obstruct the supply of the air to the installation region in order to lead to extinction.

Now, carbon dioxide used for the fire extinguishing system has the power of obstructing the inflow of the air to the region of fire occurrence, but it lacks the fire extinguishing action. Accordingly, considerable quantity of carbon dioxide is needed to obtain the expected effect. Moreover, when a large quantity of carbon dioxide is jetted out into a closed room such as a clean room, the entire interior of the room finds itself in an oxygen deficient condition.

For this reason, the recent trend is to use a halogenated hydrocarbon (trade name "Halon" made by Du Pont, Corp.) in place of carbon dioxide. The characteristics of Halon are as follows.

1. That it has a strong chemically negative catalytic effect, that is, it has a strong action to stop the combustion chain reaction, and it has a strong combustion suppressing action (the quantity of gas needed for extinction is approximately one third of that of carbon dioxide).

2. That it is a poor electrical conductor.

3. That it does not react with metals, so that there is hardly any contamination of metals accompanying the gas discharge at extinction.

4. That it is harmless to man and beast.

5. That it is extremely stable chemically so that the periodic exchange which is ordinarily required for other extinguishing reagents is not necessary.

An example of fire extinguishing systems constructed by using Halon that possesses the above-mentioned characteristics in place of carbon dioxide is an apparatus which is put in the market by Nomi Disaster Prevention Industrial Co. under the name of "Halon 1301 type Fire Extinguishing System". This system sharply reduces the required quantity of the extinguishing reagent compared with the system employing carbon dioxide, by making an advantageous use of the aforementioned characteristics of Halon gas. Moreover, utilizing the low contamination property listed as the third item of the characteristics of Halon, this fire extinguishing system has become to be in widespread use not only for the cleaning tanks for electronic components but also for the treatment baths where etching and surface working treatment take place.

However, Halon is an expensive material so that the cost runs high even if the required quantity is little. Furthermore, when it is thermally decomposed at high temperatures, it generates fluorides because it is a halogenated hydrocarbon, and the fluorides thus generated spoils the earth's environments by destroying the ozone layer above the earth. Because of this, it was decided in the Working Committee meeting for Protocol Amendment held at Montreal in November, 1989 that the use of the substance be wholly abolished by the year 2000.

BRIEF SUMMARY OF THE INVENTION

Objects of the Invention

It is a first object of the present invention to provide a fire extinguishing system which brings about a powerful extinction action without depending upon a gas that has side effects such as ozone layer destruction. It is a second object of the present invention to provide a fire extinguishing system which does not accompany contamination of an object of extinction and the interior of the room that houses the object. It is a third object of the present invention to provide a fire extinguishing system which does not give rise to an oxygen deficient condition within a room that houses an object of extinction. It is a fourth object of the present invention to provide a fire extinguishing system which can suppress the operation and maintenance cost at a low level.

SUMMARY OF THE INVENTION

According to the present invention, there can be obtained a fire extinguishing system which is equipped with a detector which detects a fire in the chemical bath containing a flammable chemical and generates a detection signal, an injection nozzle which jets out a nonflammable gas toward the liquid surface of the flammable chemical in response to the detection signal to shut off the air from the chemical by filling the surroundings of the chemical with the nonflammable gas, chemical discharging means for discharging the flammable chemical from the chemical bath to an auxiliary bath in response to the detection signal, and water supply means for supplying water to the auxiliary bath in order to dilute and cool the chemical.

When the chemical under consideration is a chemical which generates harmful gas such as methylethyl ketone (MEK), it is preferable that there is attached an inert gas supply unit which supplies an inert gas for diluting the harmful gas in either of the pipeline in the chemical discharge mechanism or the auxiliary bath.

Moreover, it is preferable that a shutter mechanism which obstructs the supply of the air by blocking the opening surface of the chemical bath in response to the detection signal, along with the fire extinguishing system.

BRIEF DESCRIPTION OF THE DRAWINGS

The above-mentioned and other objects, features and advantages of this invention will become more apparent by reference to the following detailed description of the invention taken in conjuction with the drawings, wherein.

DETAILED DESCRIPTION OF THE PREFERRED EMBODIMENTS

Figure 1:
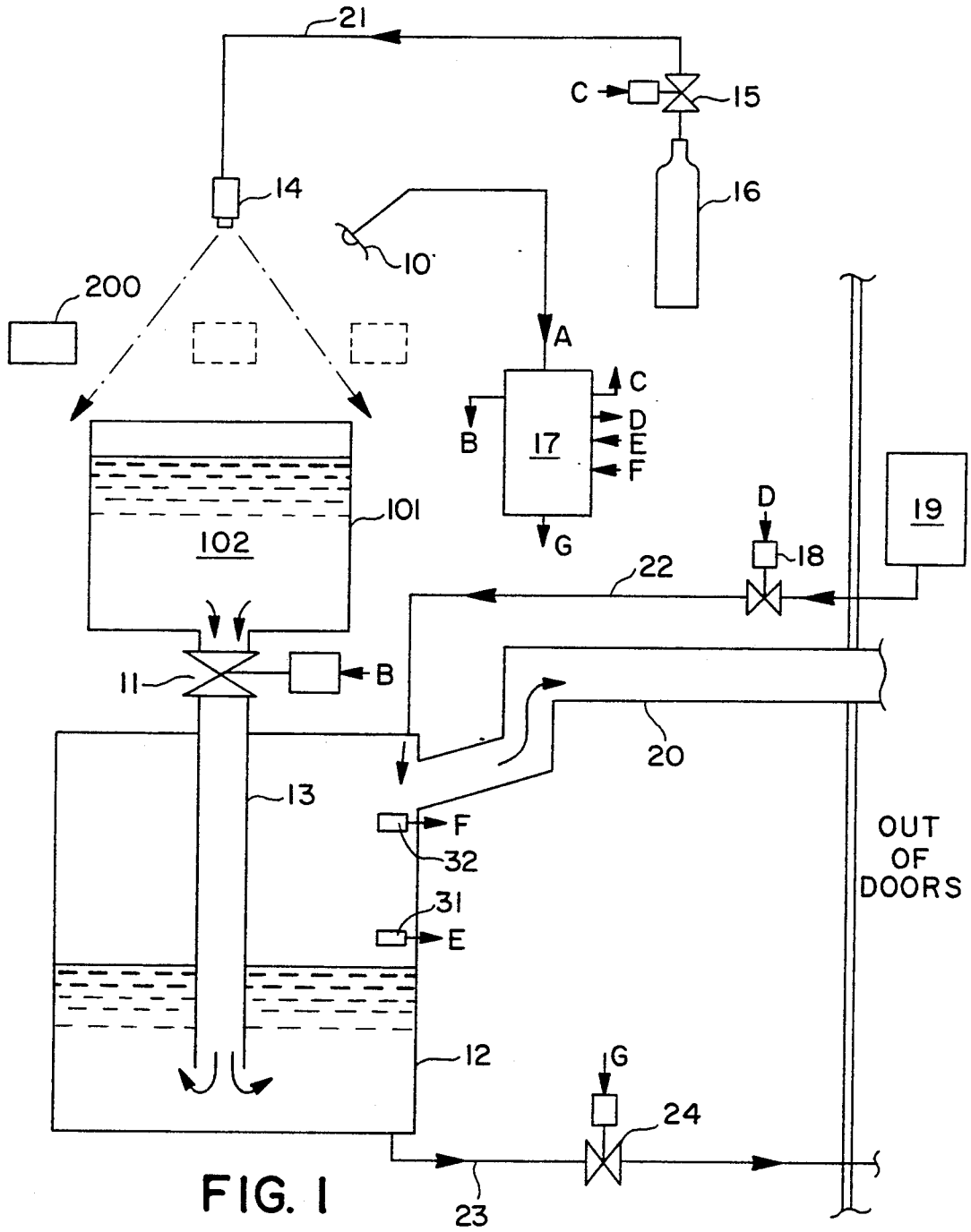
FIG. 1 is a block diagram for a first embodiment of the present invention.

Referring to FIG. 1 showing the first embodiment of the present invention, this fire extinguishing system includes a chemical bath 101 which houses a chemical 102, a valve 11 which is fixed to the bottom part of the bath 101, and a carrier 200 which runs above the tank 101 in horizontal direction. The outlet of the valve 11 is connected to an auxiliary bath 12 which stores the chemical which is discharged from the bath 101, via a pipeline 13. A feed water equipment 19 which supplies water is connected to the auxiliary bath 12 via a shut-off value 18. On the other hand, above the bath 101 there is arranged a injection nozzle 14 which radially jets out carbon dioxide that is supplied from a container through a valve 15 to the surface of the chemical, and a detector 10 which detects the flaming from the surface of the chemical is arranged obliquely above the bath 101. Detected signal A from the detector 10 is supplied to a control circuit 17, and the control circuit 17 generates signals B, C and D which control the opening of the value 11 for controlling the chemical discharge, the shut-off valve 15 which controls the supply of the nonflammable gas to the injection nozzle 14, and the shut-off valve 18 for water supply control, respectively.

Here, it is possible to dilute more quickly the chemical that is discharged from the bath 101 through the valve 11 by filling in advance the auxiliary bath 12 with water. Moreover, it is possible to quickly cool the chemical whose temperature is raised by the fire. A level sensor 31 is provided for the auxiliary bath 12 in order to monitor in advance whether an amount of water suitable for that purpose exists in the auxiliary bath 12. The level within the auxiliary bath 12 is thus always kept constant by the signal from the sensor 31. If the level is below a predetermined level, then the signal E is not generated, and as a result, the control circuit 17 generates a signal D, opens the shut-off value 18, and supplies water to the auxiliary bath 12. At the time of occurrence of a fire, the output signal E of the sensor 31 is nullified by a signal from the detector 10, the shut-off valve 18 is kept open, and water continues to be supplied.

Further, a sensor 32 which is provided for the auxiliary bath 12 for detecting the upper limit of the liquid level, generates a sensor output F for stopping the supply of water so as to prevent the liquid level of the auxiliary bath 12 from going higher than the opening of the pipeline 20, and supplies the signal F to the control circuit 17. The pipeline 13 is arranged such that its lower end extends to near the bottom surface of the auxiliary bath 12 in order to facilitate the dilution of the chemical from the bath 101 with water. In case there is need for further promoting dilution of the chemical, a nitrogen gas bubbler will be installed.

Next, the operation of the fire extinguishing system will be described. When the chemical 102 catches fire and generates flames for some reason, the detector 10 generates a detection signal A which is supplied to the control circuit 17. The signals B, C and D that are generated by the control circuit 17 in response to the signal A, open the values 11, 15 and 18, respectively, and as a result, the chemical 102 in the bath 101 is discharged, carbon dioxide from the container 16 is discharged from the injection nozzle 14, and the water from the feed water equipment 19 is introduced to the auxiliary bath 12. The injection of carbon dioxide from the injection nozzle 14 stops after lapse of a predetermined length of time determined corresponding to the volume of the work room in which is installed the fire extinguishing system. Namely, the injection of carbon dioxide is stopped so as not the concentration of carbon dioxide within the room to exceed 8% at which the breathing of the worker becomes difficult. The chemical discharged to the auxiliary bath 12 through the valve 11 which is kept open is diluted and cooled in the bath 12 by water from the feed water equipment 19, and accelerates extinction. When the liquid level of the bath 12 is raised, and the sensor 32 generates a level detection signal F and supplies it to the control circuit 17, the signal D is turned off, the shut-off valve 18 is closed, and water supply is stopped.

Upon detection by the detector 10 that the flames are subsided by extinction the detection signal A is turned off, the control circuit 17, in response to it, opens valve 24 of a drainage pipe 23 by a signal G and drains the diluted chemical in the auxiliary tank 12 to outdoors. In this stage, the diluted chemical has a concentration which is harmless to man and beast. After completion of the draining, the signal G is turned off by a reset signal, the valve 24 is closed in response to it, and water is introduced again into the auxiliary tank 12 by keep opening the valve 18.

As described in the above, the present fire extinguishing facility is characterized in that the quantity of required carbon dioxide is suppressed to a low level by jetting out carbon dioxide toward flames in the initial stage immediately after start of a fire, the inflamed chemical is discharged to be diluted with water and to raise the flashing point of the chemical by cooling it, and the chemical is drained to out of doors by diluting it to a concentration that is harmless to man and beast. Furthermore, the quantity of carbon dioxide required for extinction can be suppressed to a low level so that it is possible to avoid contamination of room and the apparatus, and prevent the worker from finding himself in an oxygen deficient condition. Moreover, the cost of gas for extinction can sharply be reduced compared with the case of using Halon.

Now, the degree of dilution of the chemical in the embodiment of the present invention varies with the flashing point of the chemical employed. For (1) isopropyl alcohol and (2) a chemical consisting of one-to-one mixed solution of isopropyl alcohol and methylethyl ketone as examples, it was confirmed that the degree of dilution is sufficient if the concentration is equal to or less than 3% for the chemical at room temperature (25° C.) for example (1), and the concentration of 9% for the chemical at room temperature for example (2).

Furthermore, the required quantity of water for dilution and cooling in the present embodiment varies also with the kind of the waste solution. According to the result of an experiment at room temperature it was found sufficient if the quantity of water is about three to seven times the contents of the chemical bath 101. However, when a toxic chemical is used and it is required to dilute the chemical to a concentration which is harmless to man and beast, greater quantity of water than in the above will be needed. In this case, such measures as giving the auxiliary bath a double construction or forming the auxiliary bath with two baths can be employed.

Figure 2:
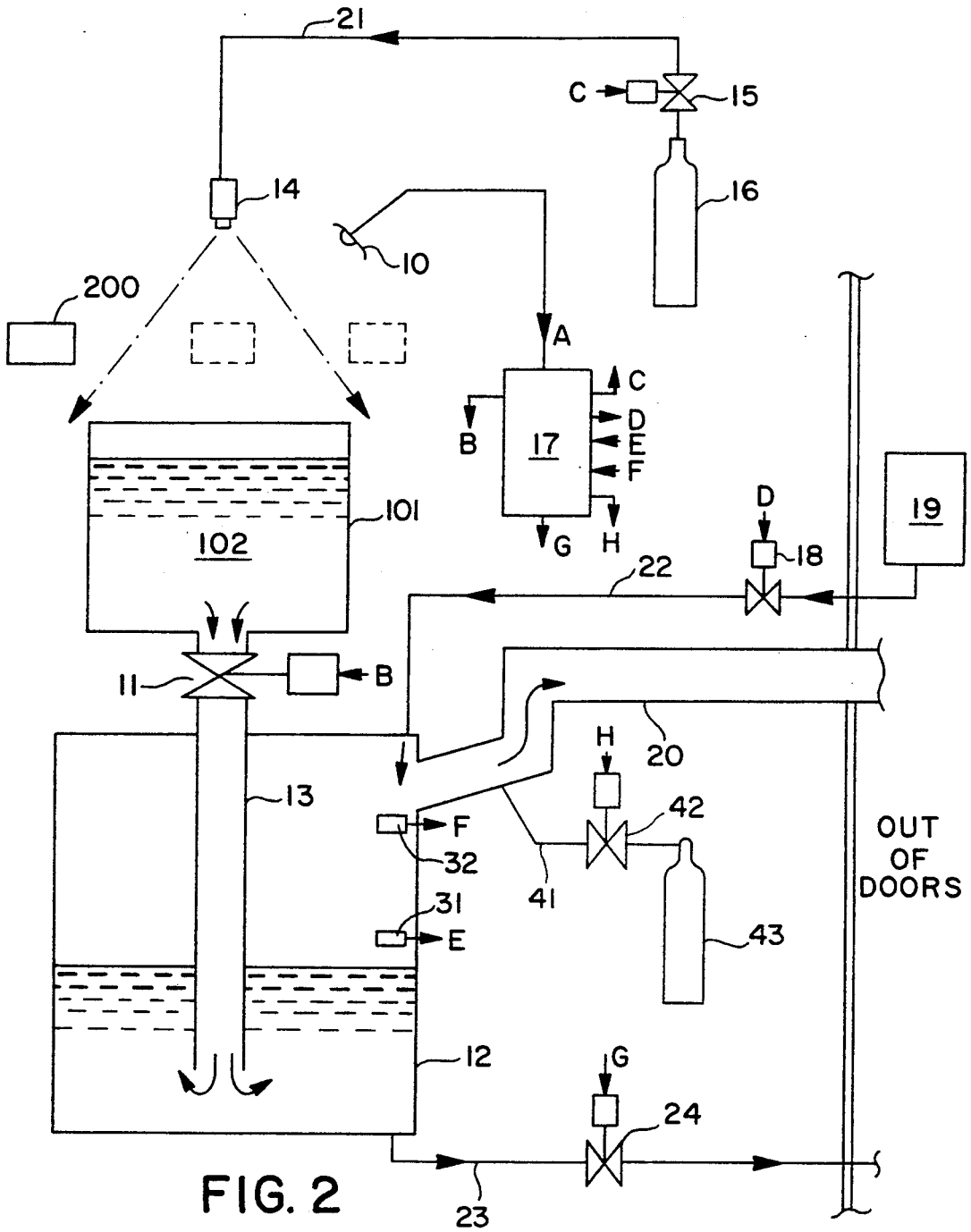
FIG. 2 is a block diagram for a second embodiment of the present invention.

Next, referring to FIG. 2 which schematically illustrates a second embodiment of the present invention adapted for the case where the chemical for extinction contains a chemical which generates a harmful gas such as methylethyl ketone, the constituents of the present embodiment that are common to those in the first embodiment are shown with identical symbols. This embodiment has a construction in which an inert gas container 43 for supplying an inert gas is connected via a valve 42 and a pipeline 41 to the pipeline 20 for discharging the chemical in the first embodiment.

Moreover, although argon, neon or nitrogen may be used as the inert gas, carbon dioxide is employed in the present embodiment because carbon dioxide is advantageous from the cost viewpoint. This embodiment executes the operation same as that of the first embodiment when a detection signal A of flames is supplied by the detector 10 to the control circuit 17. At the same time, the valve 42 is opened in response to a signal H from the control circuit 17, and supplies carbon dioxide from the container 43 to the auxiliary bath 12 through the pipeline 20. Substances evaporated from the chemical 102 discharged to the auxiliary bath 12 through the pipeline 13 are diluted by carbon dioxide within the bath 12, and the diluted gas is discharged to the out of doors through the pipeline 20. The remaining operation is the same as the operation of the fire extinguishing system described in the above so that a further detailed explanation of this embodiment will not be given.

Figure 3A:
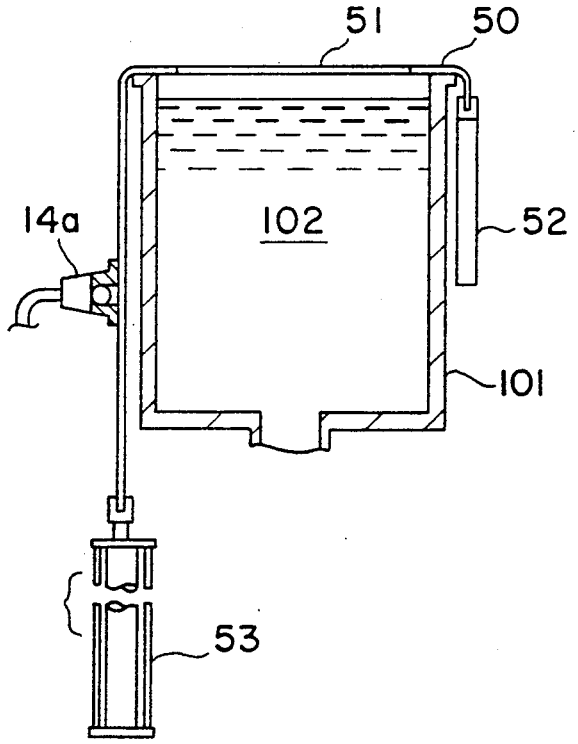
FIGS. 3*a–b* is a sectional view showing the principal part of the shutter mechanism that can be applied to the above-mentioned embodiments of the present invention.
Figure 3B:
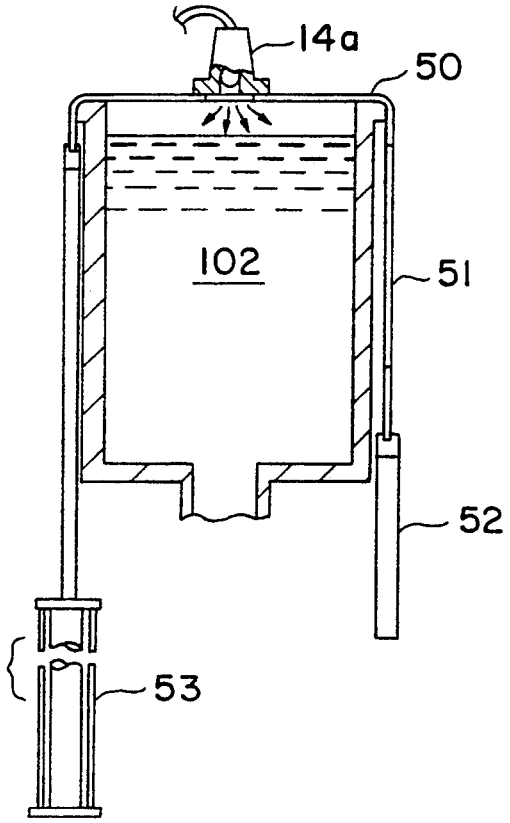

Next, when the object of extinction is a chemical which contains alkylbenzene as the principle constituent, through the flashing point is high, there is generated a large amount of smoke once it catches fire. The smoke is not only harmful to human body but also contaminates the electronic components and devices used for them. Accordingly, for a fire extinguishing system aimed at such a chemical it is preferable that there is provided a cap member for blocking the opening of the chemical tank along with the fire detection. However, this cap member has to have a mchanism which will not interfere with the operation of the carrier 200 that is arranged above the bath. Referring to FIGS. 3(*a*) and 3(*b*) which show schematic vertical sections of the portions of the chemical bath 101 of the first and the second embodiments, there is shown a cap member constructed so as to satisfy the above-mentioned requirements.

Namely, the cap member includes a shutter member 50 consisting of a strip formed nonflammable cloth which has a hole 51 with size comparable to that of the bath 101 opened on one side of one of the half portions of longitudinal direction, a counter weight 52 which is attached to one end of the shutter member 50 so as to move the shutter member 50 between a position where the hole 51 coincides with the opening of the bath 101 and a position where it is completely out of coincidence, and a piston member 53 attached to the other end of the nonflammable cloth.

At ordinary times, the shutter member 50 is held at the position where the hole 51 coincides with the opening of the bath 101 (FIG. 3(*a*)). In this state it is possible to give the electronic components such treatments as washing because the surface of the chemical is exposed. When flames are detected by the detector 10 and a signel A is supplied to the control circuit 17, the piston member 53 is driven in response to the signal C, and the shutter member 50 is moved to the position shown in FIG. 3(*b*) to block the opening of the bath 101. In response to the completion of this operation the injection nozzle 14*a* sprays carbon dioxide to the liquid surface. Then, the valve 11 is opened and the chemical 102 is discharged out of the bath 101 similar to the embodiment in the above.

Since the shutter member 50 completely blocks the opening of the bath 101, it can stop the supply of the air, not only preventing the spreading of fume in the room, there can also be obtained an effect of quickening the extinction by suppressing the chain reaction of combustion in the early stage of the fire. Moreover, the back flow of a harmful gas from the pipeline and the auxiliary bath can also be prevented. It should be mentioned that is is obvious that this shutter mechanism can similarly be applied in the same way to a chemical bath which has no possibility of generating harmful gases. In that case, the injection nozzle 14*a* is unnecessary. The material for the shutter member is not limited to nonflammable cloths such as glass wool, and stainless steel or the like can also be used.

Although the invention has been described with reference to specific embodiments, this description is not ment to be construed in a limiting sense. Various modifications of the disclosed embodiments, as well as other embodiments of the invention, will become apparent to persons skilled in the art upon reference to the description of the invention. It is therefore contemplated that the appended claims will cover any modifications or embodiments as fall within the true scope of the invention.

What is claimed is:

1. A fire extinguishing system comprising:

detecting means arranged within a closed space with high airtightness for generating a detection signal by detecting flames generated on the surface of a chemical bath containing a flammable chemical;

an injection nozzle which jets out a nonflammable gas toward the liquid surface of said chemical in response to said detection signal;

an auxiliary tank which temporarily stores said chemical discharged from said chemical bath in response to said detection signal;

a feed water equipment which supplies water to the auxiliary bath is response to said detection signal to dilute and cool said chemical; and a pipeline which discharges the vapor component of the chemical within said auxiliary bath from said closed space.

2. A fire extinguishing system as claimed in claim 1, further comprising means for supplying an inert gas to dilute said vapor component of the chemical within said auxiliary bath.

3. A fire extinguishing system as claimed in claim 1 further comprising:

a shutter member including a strip-formed nonflammable material which can slide in its longitudinal direction by keeping a closely contacted condition with the opening of said chemical bath, having a hole with a size comparable to said opening in a first one-half portion in the longitudinal direction of said shutter member, and being arranged in close contact with said opening; and means for holding at ordinary times the shutter member in the state in which said first one half portion is positioned at said opening, and driving the shutter member so as to have a second one-half portion positioned at said opening in response to said detection signal.

4. A fire extinguishing system as claimed in claim 3, wherein said injection nozzle is attached to said second one-half portion of said shutter member.

5. A fire extinguishing system as claimed in claim 2 further comprising:

a shutter member including a strip-formed nonflammable material which can slide in its longitudinal direction by keeping a closely contacted condition with the opening of said chemical bath, having a hole with a size comparable to said opening in a first one-half portion in the longitudinal direction of said shutter member, and being arranged to close contact with said opening; and means for holding at ordinary times opening; and in the state in which said first one half portion is positioned at said opening, and driving the shutter member so as to have a second one-half portion positioned at said opening in response to said detection signal.

* * * * *

UNITED STATES PATENT AND TRADEMARK OFFICE

CERTIFICATE OF CORRECTION

PATENT NO. : 5,163,517

DATED : November 17, 1992

INVENTOR(S) : Kozai et al.

It is certified that error appears in the above-identified patent and that said Letters Patent is hereby corrected as shown below:

Item no. 57, Abstract, line 1, change "relates" to --related--.

Claim 1, col. 7, line 14, change "is" to --in--.

Signed and Sealed this

Fifth Day of October, 1993

*Attest:*

*Attesting Officer*

BRUCE LEHMAN

*Commissioner of Patents and Trademarks*